US009091130B2

(12) United States Patent
Lebeck

(10) Patent No.: US 9,091,130 B2
(45) Date of Patent: Jul. 28, 2015

(54) ROCK BIT HAVING A RADIALLY SELF-ALIGNING METAL FACED SEAL

(71) Applicant: Varel International, Ind., L.P., Carrollton, TX (US)

(72) Inventor: Alan Otto Lebeck, Albuquerque, NM (US)

(73) Assignee: Varel International, Ind., L.P., Carrollton, TX (US)

( * ) Notice: Subject to any disclaimer, the term of this patent is extended or adjusted under 35 U.S.C. 154(b) by 347 days.

(21) Appl. No.: 13/766,049

(22) Filed: Feb. 13, 2013

(65) Prior Publication Data

US 2014/0224547 A1 Aug. 14, 2014

(51) Int. Cl.
*E21B 10/22* (2006.01)
*E21B 10/25* (2006.01)

(52) U.S. Cl.
CPC ..... *E21B 10/25* (2013.01)

(58) Field of Classification Search
CPC ..... E21B 10/22; E21B 10/25
USPC ..... 175/371; 384/92, 94
See application file for complete search history.

(56) References Cited

U.S. PATENT DOCUMENTS

| | | | | |
|---|---|---|---|---|
| 3,572,452 | A | 3/1971 | Winberg | |
| 4,172,502 | A * | 10/1979 | van Nederveen | 175/369 |
| 4,199,156 | A | 4/1980 | Oldham et al. | |
| 4,249,622 | A | 2/1981 | Dysart | |
| 4,388,984 | A | 6/1983 | Oelke | |
| 4,494,749 | A | 1/1985 | Evans | |
| 4,516,641 | A | 5/1985 | Burr | |
| 4,519,719 | A | 5/1985 | Burr | |
| 4,623,028 | A | 11/1986 | Murdoch et al. | |
| 4,629,338 | A * | 12/1986 | Ippolito | 384/94 |
| 4,666,001 | A | 5/1987 | Burr | |
| 4,671,368 | A | 6/1987 | Burr | |
| 4,722,404 | A | 2/1988 | Evans | |
| 4,747,604 | A | 5/1988 | Nakamura | |
| 4,753,303 | A | 6/1988 | Burr | |

(Continued)

FOREIGN PATENT DOCUMENTS

| | | |
|---|---|---|
| EP | 0282431 | 7/1883 |
| EP | 0040845 A2 | 12/1981 |

(Continued)

OTHER PUBLICATIONS

International Search Report and Written Opinion for PCT/US2013/071230 mailed Feb. 24, 2014 (9 pages).

*Primary Examiner* — Kenneth L Thompson
(74) *Attorney, Agent, or Firm* — Gardere Wynne Sewell LLP; Andre M. Szuwalski

(57) ABSTRACT

A sealing system includes a first gland in a cone and a second gland in a shaft region. A first ring is mounted in the first gland, a second ring is mounted in the second gland and a third ring is positioned between the first and second rings. The first and third rings present a pair of metal seal faces. A third ring is mounted to the second ring through a set of mounting pins which permit axial movement of the third ring. A biasing spring is mounting in the second ring and configured to exert an axial force against the third ring so as to keep the metal seal faces in sealing contact. A third gland is formed between the second and third rings, with an o-ring sealing member installed within the third gland and compressed in a sealing relationship between the second and third rings.

23 Claims, 8 Drawing Sheets

(56) References Cited

U.S. PATENT DOCUMENTS

| | | | |
|---|---|---|---|
| 4,762,189 | A | 8/1988 | Tatum |
| 4,792,146 | A | 12/1988 | Lebeck et al. |
| 4,822,057 | A | 4/1989 | Chia et al. |
| 4,824,123 | A | 4/1989 | Chia et al. |
| 4,834,400 | A | 5/1989 | Lebeck |
| 4,836,561 | A | 6/1989 | Lebeck et al. |
| 4,838,365 | A | 6/1989 | Kotch |
| 4,887,395 | A | 12/1989 | Lebeck et al. |
| 4,903,786 | A | 2/1990 | Welsh |
| 4,923,020 | A | 5/1990 | Kelly, Jr. et al. |
| 4,973,068 | A | 11/1990 | Lebeck |
| 5,040,624 | A | 8/1991 | Schumacher et al. |
| 5,080,183 | A | 1/1992 | Schumacher et al. |
| 5,251,914 | A | 10/1993 | Tatum |
| 5,295,549 | A | 3/1994 | Dolezal et al. |
| 5,360,076 | A | 11/1994 | Kelly, Jr. et al. |
| 5,513,715 | A | 5/1996 | Dysart |
| 5,740,871 | A | 4/1998 | Williams |
| 5,791,421 | A | 8/1998 | Lin |
| 6,003,875 | A | 12/1999 | Ellis et al. |
| 6,026,917 | A | 2/2000 | Zahradnik et al. |
| 6,045,029 | A | 4/2000 | Scott |
| 6,109,376 | A | 8/2000 | Pearce |
| 6,176,330 | B1 | 1/2001 | Burr |
| 6,209,185 | B1 | 4/2001 | Scott |
| 6,213,473 | B1 | 4/2001 | Lebeck |
| 6,247,545 | B1 | 6/2001 | Burr et al. |
| 6,254,275 | B1 | 7/2001 | Slaughter, Jr. et al. |
| 6,401,843 | B1 | 6/2002 | Besson et al. |
| 6,427,790 | B1 | 8/2002 | Burr |
| 6,513,607 | B2 | 2/2003 | Peterson et al. |
| 6,684,966 | B2 | 2/2004 | Lin et al. |
| 6,918,594 | B2 | 7/2005 | Sund et al. |
| 7,117,961 | B2 | 10/2006 | Yong et al. |
| 7,128,173 | B2 | 10/2006 | Lin |
| 7,188,691 | B2 | 3/2007 | Yong et al. |
| 7,311,159 | B2 | 12/2007 | Lin et al. |
| 7,347,290 | B2 | 3/2008 | Yu et al. |
| 7,413,037 | B2 | 8/2008 | Lin et al. |
| 7,887,061 | B2 | 2/2011 | Van Dyke et al. |
| 8,752,655 | B2 | 6/2014 | Gallifet |
| 8,783,385 | B2 | 7/2014 | Lu |
| 8,967,301 | B2 | 3/2015 | Curry et al. |
| 2002/0108788 | A1 | 8/2002 | Peterson et al. |
| 2005/0023042 | A1 | 2/2005 | Yong et al. |
| 2005/0274549 | A1 | 12/2005 | Yong et al. |
| 2005/0274550 | A1 | 12/2005 | Yu et al. |
| 2008/0179103 | A1 | 7/2008 | Langford et al. |
| 2009/0107731 | A1 | 4/2009 | Fedorovich |
| 2010/0102513 | A1 | 4/2010 | Peterson |
| 2011/0297448 | A1 | 12/2011 | Lu |
| 2012/0160561 | A1 | 6/2012 | Ramirez Santiago |
| 2013/0020135 | A1 | 1/2013 | Gallifet |
| 2014/0224547 | A1 | 8/2014 | Lebeck |
| 2014/0224548 | A1 | 8/2014 | Lebeck |
| 2014/0224549 | A1 | 8/2014 | Lebeck |

FOREIGN PATENT DOCUMENTS

| | | | |
|---|---|---|---|
| EP | 0202190 | A1 | 11/1986 |
| EP | 0716253 | A1 | 6/1996 |
| EP | 0821132 | A2 | 1/1998 |

* cited by examiner

ROCK BIT HAVING A RADIALLY SELF-ALIGNING METAL FACED SEAL

CROSS-REFERENCE TO RELATED APPLICATIONS

This application is subject matter related to, and incorporates by reference, the following commonly assigned and copending applications for patent: ROCK BIT HAVING A FLEXIBLE METAL FACED SEAL, by Alan O. Lebeck, application Ser. No. 13/766,118, filed Feb. 13, 2013; and ROCK BIT HAVING A PRESSURE BALANCED METAL FACED SEAL, by Alan O. Lebeck, application Ser. No. 13/766/166, filed Feb. 13, 2013.

BACKGROUND

1. Technical Field

The present invention relates to earth boring bits, and more particularly to those having rotatable cutters, also known as cones.

2. Description of Related Art

Earth boring bits with rolling element cutters have bearings employing either rollers as the load carrying element or with a journal as the load carrying element. The use of a sealing means in such rock bit bearings has dramatically increased bearing life in the past fifty years.

Early seals for rock bits were designed with a metallic Belleville spring clad with an elastomer, usually nitrile rubber (NBR). The metallic spring provided the energizing force for the sealing surface, and the rubber coating sealed against the metal surface of the head and cone and provided a seal on relatively rough surfaces because the compliant behavior of the rubber coating filled in the microscopic asperities on the sealing surface. Belleville seals of this type were employed mainly in rock bits with roller bearings. The seal would fail due to wear of the elastomer after a relatively short number of hours in operation, resulting in loss of the lubricant contained within the bearing cavity. The bit would continue to function for some period of time utilizing the roller bearings without benefit of the lubricant.

A significant advancement in rock bit seals came when o-ring type seals were introduced. These seals were composed of nitrile rubber and were circular in cross section. The seal was fit into a radial gland formed by cylindrical surfaces between the head and cone bearings, and the annulus formed was smaller than the original dimension as measured as the cross section of the seal. The o-ring seal was then radially squeezed between the cylindrical surfaces.

To minimize sliding friction and the resultant heat generation and abrasive wear, rotating O-rings are typically provided with a minimal amount of radial compression. However, reciprocating (Belleville) seals must have a much larger radial compression to exclude contamination from the sealing zone during axial sliding (typically about twice the compression). The rock bit seal must both exclude contamination during relative head/cone axial motion and minimize abrasive wear during rotation.

Reference is now made to FIG. 1 which illustrates a prior art configuration for an earth boring bit. FIG. 2 illustrates a close-up view of the prior art configuration focusing on the area of a sealing system 2 associated with a rotating cone 4 installed on a shaft 6 of a bit head 8. An o-ring seal 10 is inserted into a seal gland 12 and squeezed between a cone sealing surface 14 and a head sealing surface 16.

Reference is now made to FIG. 3 which illustrates a prior art configuration for an earth boring bit. FIG. 4 illustrates a close-up view of the prior art configuration focusing on the area of a sealing system 22 associated with a rotating cone 24 installed on a shaft 26 of a bit head 28. A first ring 30 is press-fit into a gland 32 formed in the cone 24. The first ring 30 presents a first metal seal face 34. A second ring 36 is also placed in the gland 32. The second ring 36 presents a second metal seal face 38. An energizing structure 40 is also placed in the gland 32 and configured to apply a combination of axial and radial force against a back surface 42 of the second ring 36 so as to urge the second metal seal face 38 into contact with the first metal seal face 34. The structure shown in FIG. 4 illustrates the well-known single energizer type of metal faced sealing system.

In all configurations of metal faced sealing structures, the sealing system 22 must be provided with sufficient force through the energizing structure 40 to maintain sufficient sealing contact (between the second metal seal face 38 and first metal seal face 34) and further to overcome any pressure differential between internal and external zones. Pressure differentials between those zones fluctuate as the cone is contorted on the bearing during operation. This phenomenon is known in the art as "cone pumping." Cone pumping throws an internal pressure surge at the metal faced bearing seal which can lead to catastrophic failure of the seal over time. In addition, changes in depth while the bit is in use can cause fluctuations in pressure between the internal pressure and external pressure. Conversely, application of too much force on the seal by the energizing structure 40 can cause difficulties in assembling the cone to the bearing and may result in accelerated wear of the first and second rings 30 and 36. It is important that the metal seal faces 34 and 38 are flat, and so a lapping of the surfaces is often provided (in the light band range).

A significant challenge with the single energizer type of metal faced sealing system shown in FIG. 4 is that the press fitting of the first ring 30 in the cone gland 32 may deform the first ring and produce a "waviness" in the first metal seal face 34. The second ring 36 with second metal seal face 38 must overcome this surface waviness through the force applied by the energizing structure 40 so as to maintain the desired sealing contact (otherwise the seal will leak).

An additional challenge with the single energizer type of metal faced sealing system shown in FIG. 4 is that the elastomeric energizing structure 40 is offset so as to apply force to the second ring 36 not only in the preferred axial direction but also in the radial direction. The sealing force is accordingly dissipated by the wasted force component applied in the radial direction. The radially applied force component further introduces a torque on the second ring 36 which reduces (i.e., narrows) the radial width of the effective sealing surface where the metal seal faces 34 and 38 make sealing surface contact. The reduction in width arises because the introduced torque causes a distortion of the seal ring producing an out-of-flatness surface condition on the sealing face of the seal ring.

Yet another challenge with the single energizer type of metal faced sealing system shown in FIG. 4 is that the metal seal faces 34 and 38 become unloaded as a result of an increase in grease pressure. For example, rock bit bearings may operate with an internal pressure greater than the environment. As a result, grease leakage may occur.

Notwithstanding the foregoing challenges, metal faced sealing systems are often used in roller cone drill bits which operate at higher RPM drilling applications because the metal seal faces 34 and 38 resist wear and consequently exhibit longer operating life than a standard O-ring type sealing system like that shown in FIGS. 1 and 2.

The foregoing challenges remain an issue and thus a need exists in the art for an improved metal faced sealing system for use in rock bits.

SUMMARY

In an embodiment, a sealing system for a drill bit including a shaft region and a rotating cone comprises: a first annular gland defined in the rotating cone; a first ring press-fit in the first annular gland and having a first metal seal face; a second annular gland defined at a base of the shaft region; a second ring press-fit in the second annular gland, said second ring including a radially extending flange region having a plurality of first axially extending apertures and a plurality of second axially extending apertures; a third ring positioned between the first and second rings, said third ring including a second metal seal face in contact with the first metal seal face and further including a biasing surface axially opposite the second metal seal face and a plurality of third axially extending apertures; a spring member inserted within each first axially extending aperture and configured to apply an axial force against the biasing surface of the third ring; and a pin member inserted between each pair of second and third axially extending apertures.

In another embodiment, a sealing system for a drill bit including a shaft region and a rotating cone comprises: a first annular gland defined in the rotating cone; a first ring press-fit in the first annular gland and having a first metal seal face; a second ring mounted to the shaft region and including a flange having a plurality of first axially extending apertures; a third ring including a second metal seal face in contact with the first metal seal face and further including a biasing surface axially opposite the second metal seal face; and a biasing member inserted within each first axially extending aperture and configured to apply an axial force against the biasing surface of the third ring.

In another embodiment, a sealing system for a drill bit including a shaft region and a rotating cone comprises: a first annular gland defined in the rotating cone; a first ring press-fit in the first annular gland and having a first metal seal face; a second ring mounted to the shaft region and including a flange having a plurality of first axially extending apertures; a third ring including a second metal seal face in contact with the first metal seal face and further including a plurality of second axially extending apertures aligned with the plurality of first axially extending apertures; and a pin member inserted between each pair of second and third axially extending apertures.

BRIEF DESCRIPTION OF THE DRAWINGS

Other features and advantages of the invention will become clear in the description which follows of several non-limiting examples, with references to the attached drawings wherein.

DETAILED DESCRIPTION OF THE DRAWINGS

FIGS. 1-4 have previously been described.

Figure 1:
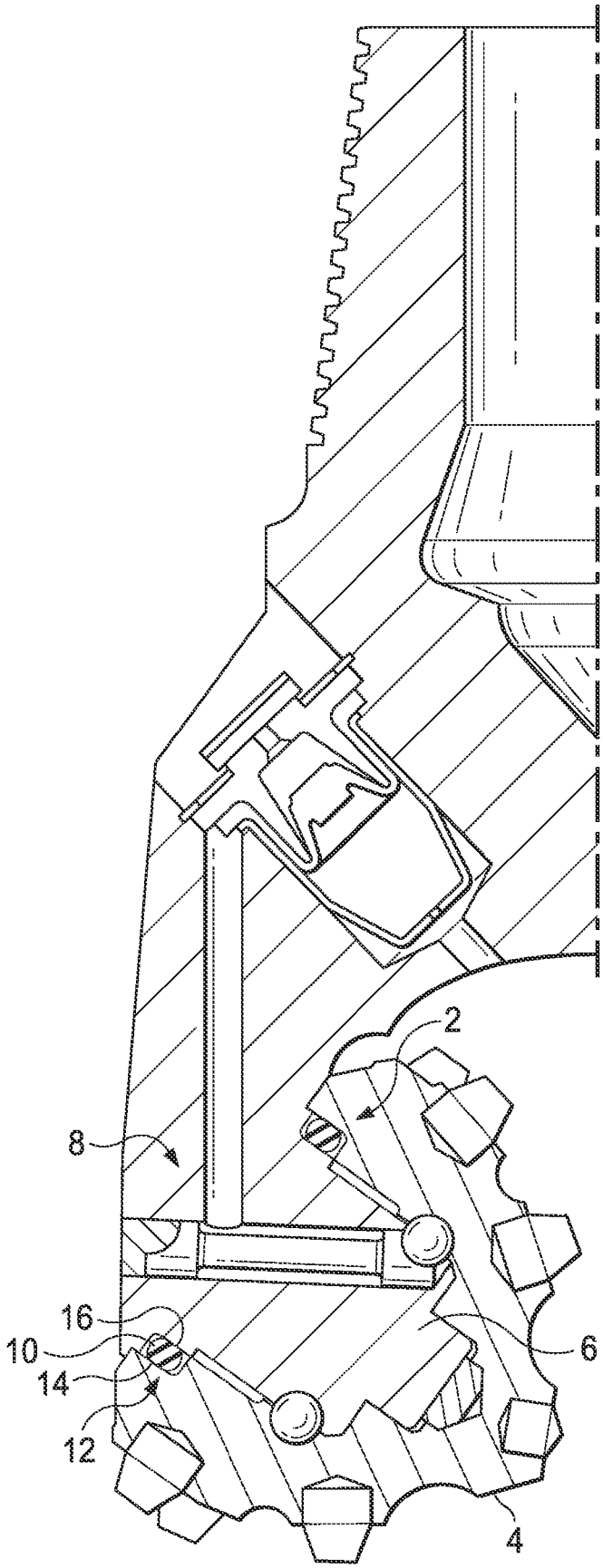
FIG. 1 (PRIOR ART)
FIG. 1 illustrates a prior art configuration for an earth boring bit with a conventional O-ring type sealing system.
Figure 2:
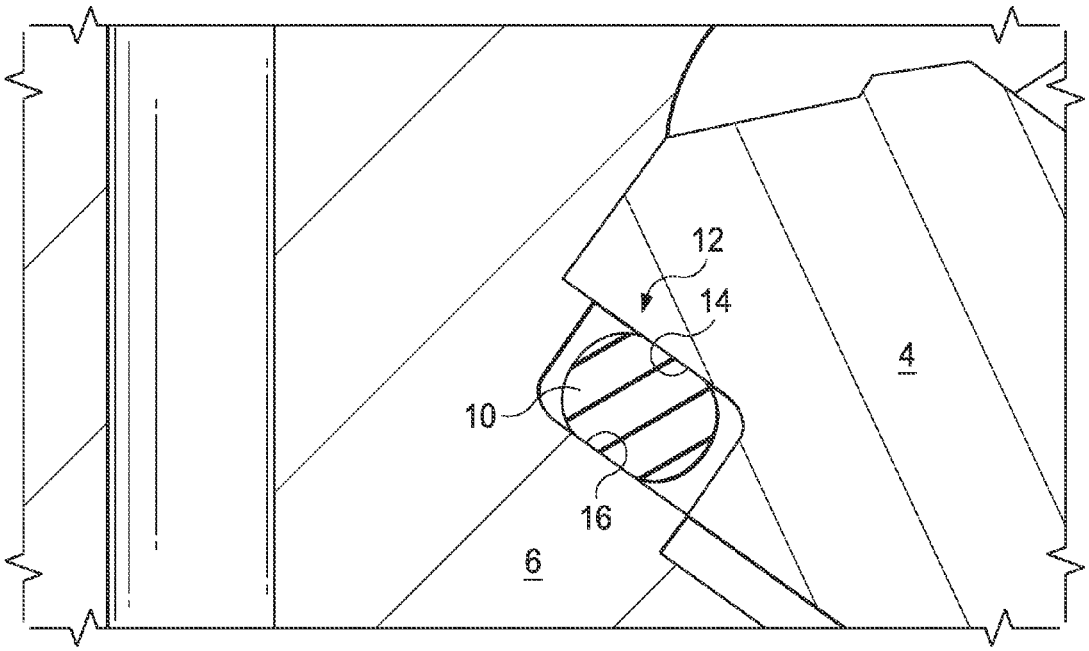
FIG. 2 (PRIOR ART)
FIG. 2 illustrates a close-up view of the prior art configuration of FIG. 1 focusing on the area of the seal.
Figure 4:
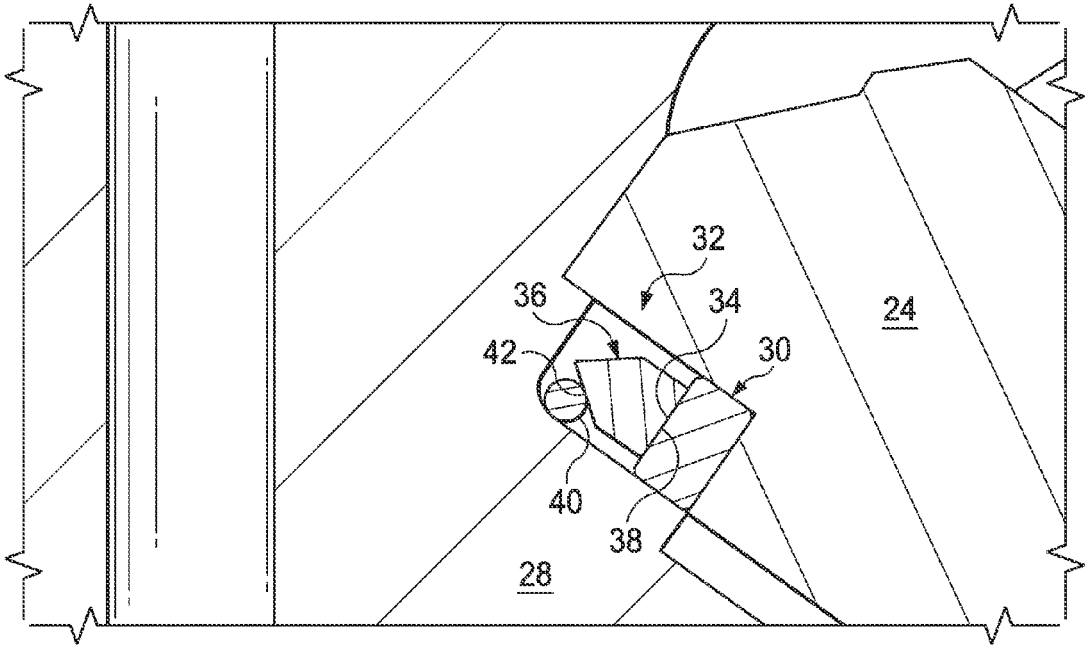
FIG. 4 (PRIOR ART)
FIG. 4 illustrates a close-up view of the prior art configuration of FIG. 3 focusing on the area of the seal.
Figure 3:
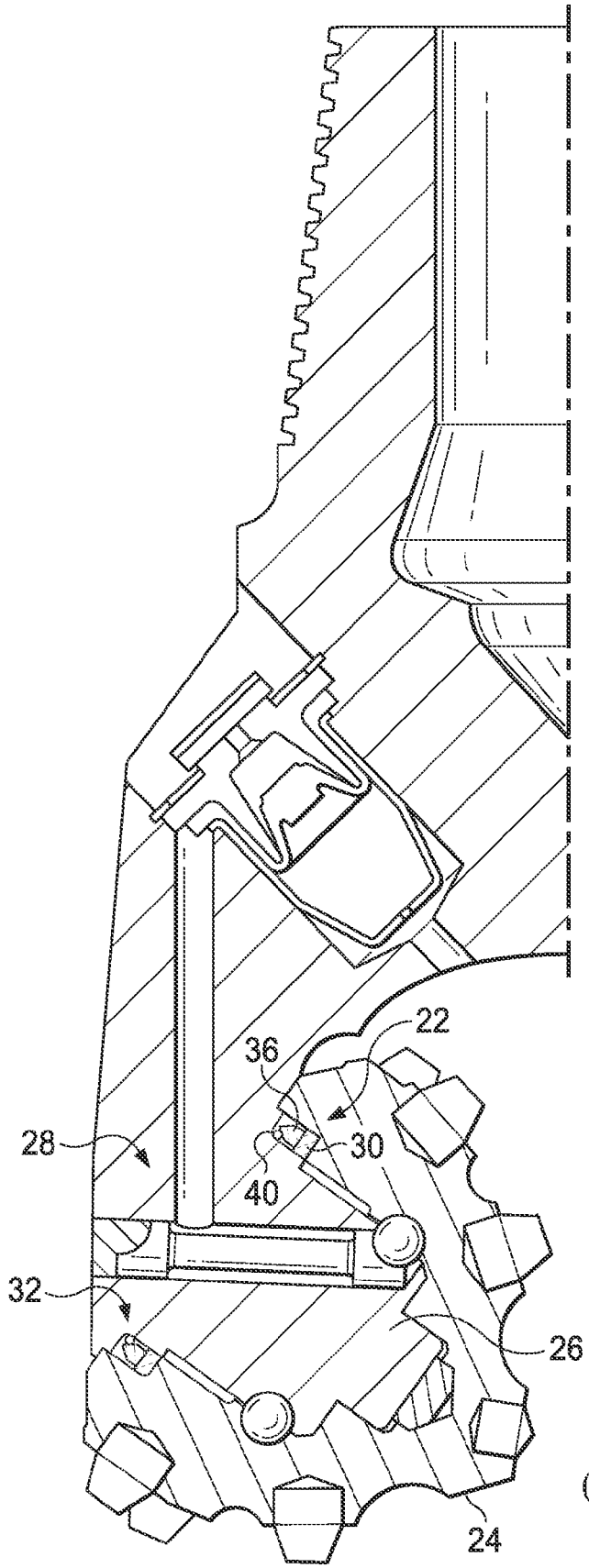
FIG. 3 (PRIOR ART)
FIG. 3 illustrates a prior art configuration for an earth boring bit with a conventional single energizer metal faced sealing system.
Figure 5A:
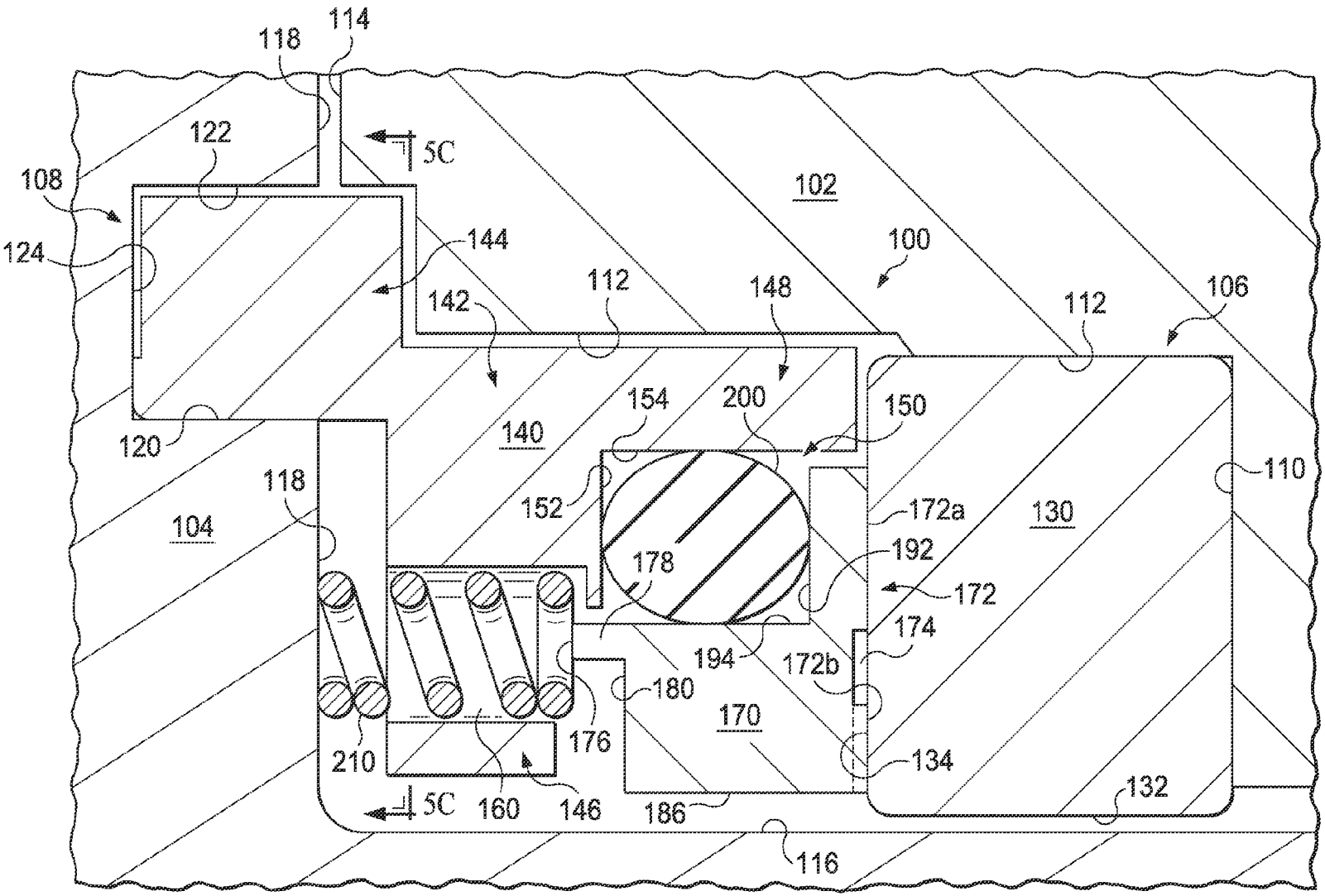
FIGS. 5A, 5B, 5C, 5D and 5E illustrate a variety of views of an embodiment of a metal faced sealing system.
Figure 5B:
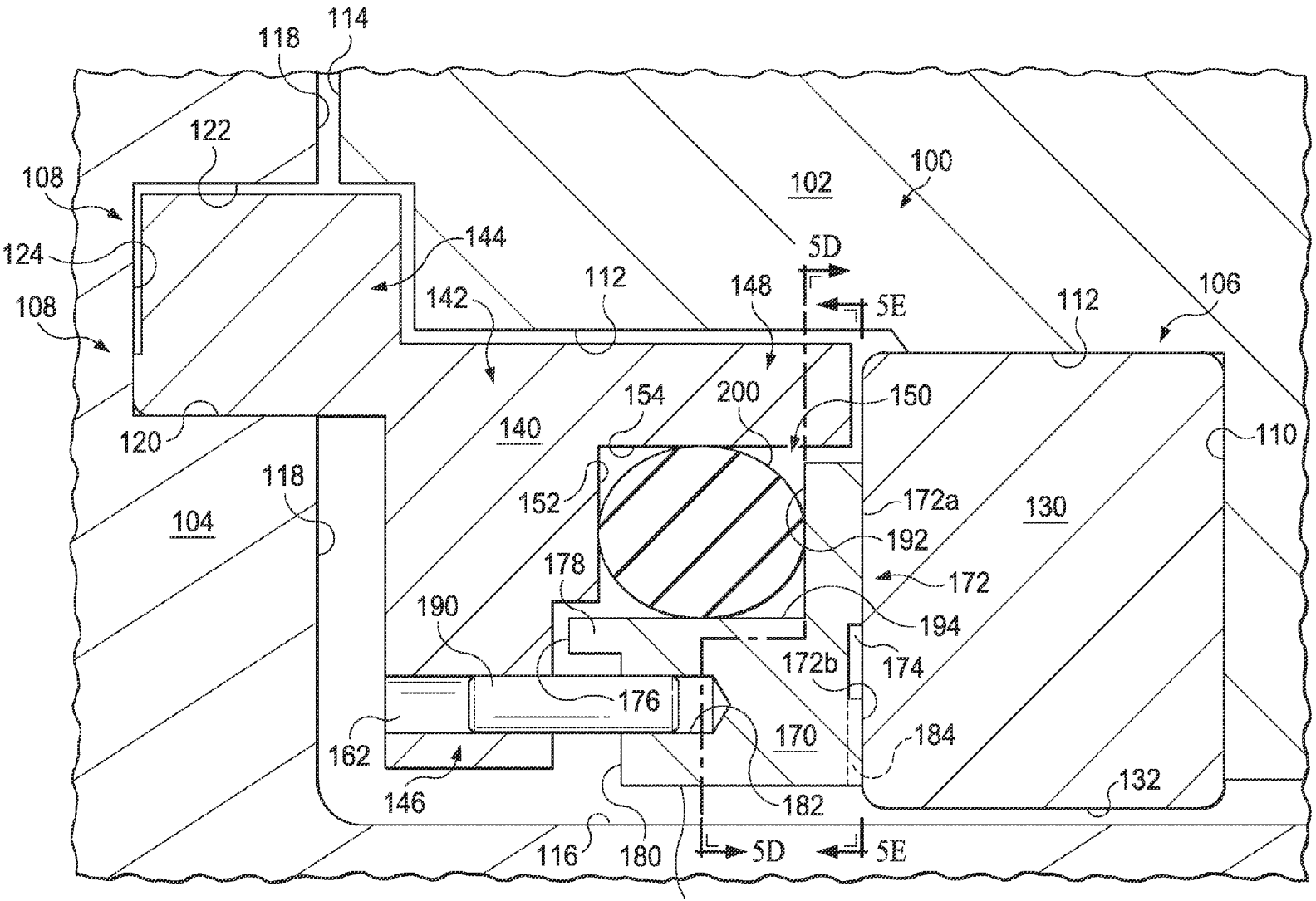

Reference is now made to FIGS. 5A and 5B which illustrate cross-sectional views at two different circumferential angles of an embodiment of a metal faced sealing system 100. The sealing system 100 is associated with a rotating cone 102 installed on a shaft region 104. The sealing system 100 is suitable for use in any sealing application including implementations where the cone is supported for rotation using a journal bearing or a roller bearing as well known to those skilled in the art.

The sealing system 100 is provided within a gland structure formed in the cone 102 and at a base of the shaft region 104. The gland structure includes a first gland 106 formed in the cone and a second gland 108 formed in the base of the shaft region 104. The first gland 106 is an annular structure defined by a radial surface 110 extending outwardly into the body of the cone 102 perpendicularly away from the axis of cone rotation and a cylindrical surface 112 extending perpendicularly and rearwardly from the radial surface towards a bottom surface (base) 114 of the cone in a direction parallel to the axis of cone rotation. The shaft region 104 is defined by a cylindrical shaft surface 116 to which the cone 102 is mounted (in a manner conventional and known to those skilled in the art) and a radial surface 118 at the base of the shaft region extending outwardly from the cylindrical journal surface 116 perpendicularly away from the axis of cone rotation. The second gland 108 is an annular channel-like structure defined in the radial surface 118 at the base of the shaft region 104 by a pair of cylindrical (channel side) surfaces 120 and 122 and a radial (channel bottom) surface 124 interconnecting the cylindrical surfaces 120 and 122 at a bottom of the annular structure. In this configuration, it will be noted that the second gland opens into the first gland.

The sealing system 100 further comprises a first ring 130 (having a generally square or rectangular cross-section) press fit into the first gland 106 against the radial surface 110 and cylindrical surface 112 at a corner where the surfaces 110 and 112 meet. An inner diameter of the first ring 130 defined by surface 132 is offset from the cylindrical surface 116 of the shaft region 104. The first ring 130 further includes a first metal seal face (using a radially extending surface) 134.

The sealing system 100 further comprises a second ring 140 (having an irregular cross-section) forming a housing member that includes a central body region 142, a rear region 144 extending rearwardly and axially from the central body region, a flange region 146 extending inwardly and radially from the central body region and a front region 148 extending frontwardly and axially from the central body region. The rear region 144 of the second ring 140 is press fit into the second gland 108 against the radial surface 124 and cylindrical surface 120 at a corner where the surfaces 124 and 120 meet. The front region 148 of the second ring 140 forms part of a third gland 150 comprising an annular structure defined by a radial surface 152 extending outwardly into the front region 148 perpendicularly away from the axis of cone rotation and a cylindrical surface 154 extending perpendicularly and frontwardly from the radial surface towards an end of the second ring 148 in a direction parallel to the axis of cone rotation.

Figure 5C:
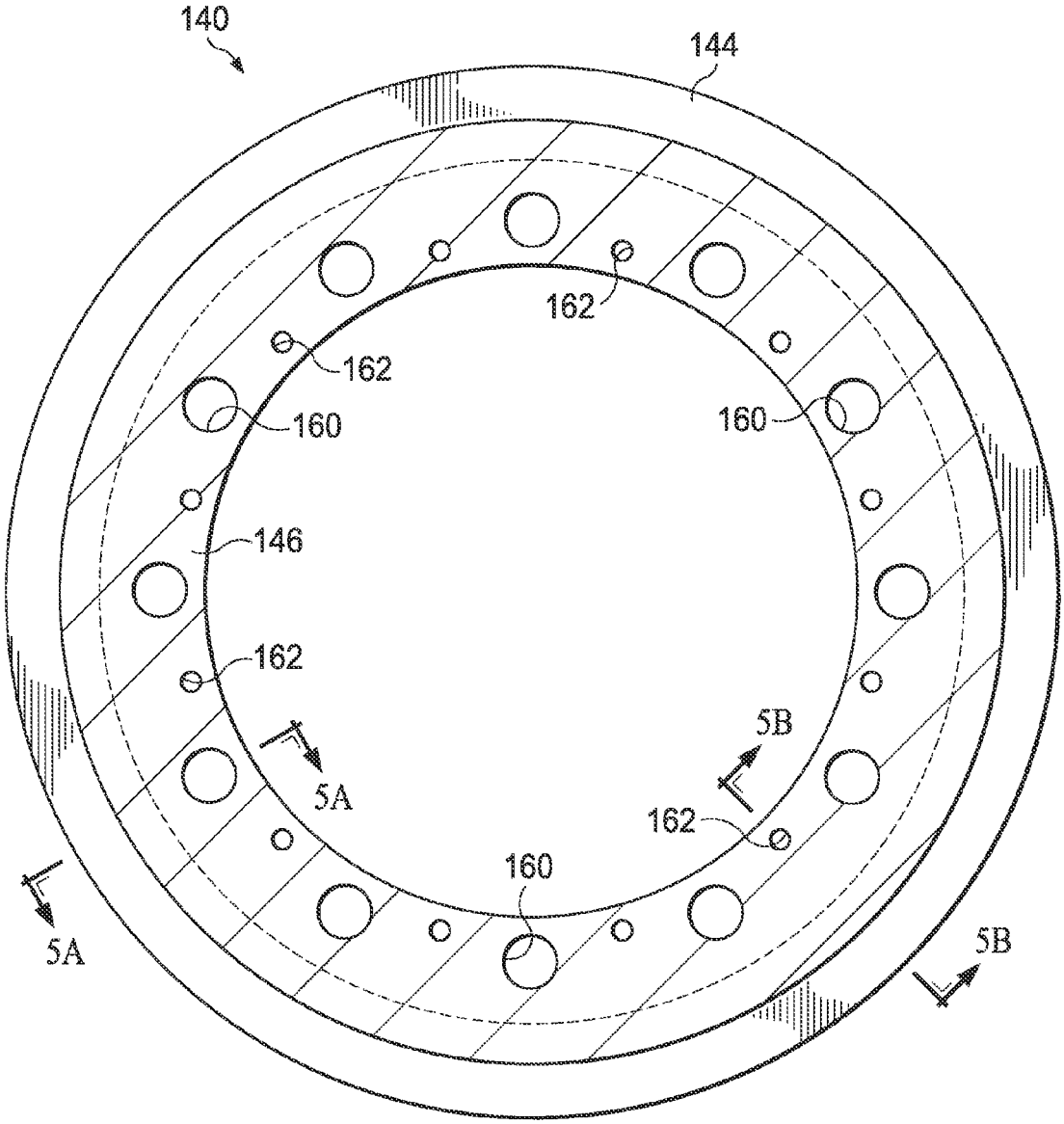

A shown in FIGS. 5A and 5C, the flange region 146 of the second ring 140 includes a plurality of axially extending first apertures 160 evenly distributed circumferentially around the inner perimeter of the flange region 146. The first apertures 160 pass completely through the flange region 146. As shown in FIGS. 5B and 5C, the flange region 146 of the second ring 140 further includes a plurality of axially extending second apertures 162 evenly distributed circumferentially around the inner perimeter of the flange region 146. The first and second apertures 160 and 162 are shown to pass completely through the flange region 146, but may in an alternative embodiment comprise blind apertures passing only partially through the flange region 146. A single one of the first apertures 160 is shown in FIG. 5A and a single one of the second apertures 162 is shown in FIG. 5B. FIG. 5C (not drawn to scale) shows the alternating distribution of the first and second apertures 160 and 162 about the inner perimeter of the flange region 146. In the illustrated embodiment, there are twelve first apertures 160 and twelve second apertures 162, so that the angular offset between pairs of first apertures and pairs of second apertures is thirty degrees. In another implementation, sixteen first apertures 160 and sixteen second apertures 162 may be provided. Fewer or more apertures may be provided in accordance with a desired design (perhaps based on the diameter of the cone and diameter of the gland 106).

The sealing system 100 further comprises a third ring 170 (having an L-shaped cross-section) that includes a second metal seal face (using a radially extending surface) 172 including a first portion 172*a* and a second portion 172*b*. The first and second portions 172*a* and 172*b* are coaxial and are separated from each other by an annular channel 174. The annular channel 174 forms a non-contacting region of the seal face that serves to separate the functions of first portion 172*a* and second portion 172*b*. The width of channel 174 is selected to ensure improved contact by the first portion 172*a*. A plurality of radially extending channels 184 are provided in the second portion 172*b* of the second metal seal face 172 to extend between an inner circumference 186 of the third ring 170 and the annular channel 174. The channels 184 support provision of pressure equalization between the channel 174 and the grease side of the seal at reference 186. Pressure equalization is desired so that the second portion 172*b* will function as a bearing surface (not a sealing surface) while the first portion 172*a* functions as a sealing surface (having a pressure differential). FIG. 5E (not drawn to scale) shows the angular distribution of the channels 184 about the inner circumference 186. The second portion 172*b* of the second metal seal face 172 is accordingly circumferentially discontinuous and thus does not participate in forming the seal (while the first portion 172*a* is circumferentially continuous and thus responsible for providing the sliding sealing surface). In the illustrated embodiment, there are twelve channels 184, so that the angular offset between channels is thirty degrees. In another implementation, sixteen channels 184 may be provided. Fewer or more channels may be provided in accordance with a desired design (perhaps based on the diameter of the cone and diameter of the gland 106).

The second metal seal face 172 is positioned in sliding/sealing contact with the first metal seal face 134. The sealing contact is made between the first portion 172*a* of the second metal seal face 172 and the first metal seal face 134 of the first ring 130. Axially opposite the second metal seal face 172, the third ring 170 further includes a biasing surface 176. In the illustrated embodiment, the biasing surface 176 is provided at the distal end of a radially extending biasing projection member 178. Also axially opposite the second metal seal face 172, the third ring 170 further includes a rear surface 180.

Figure 5D:
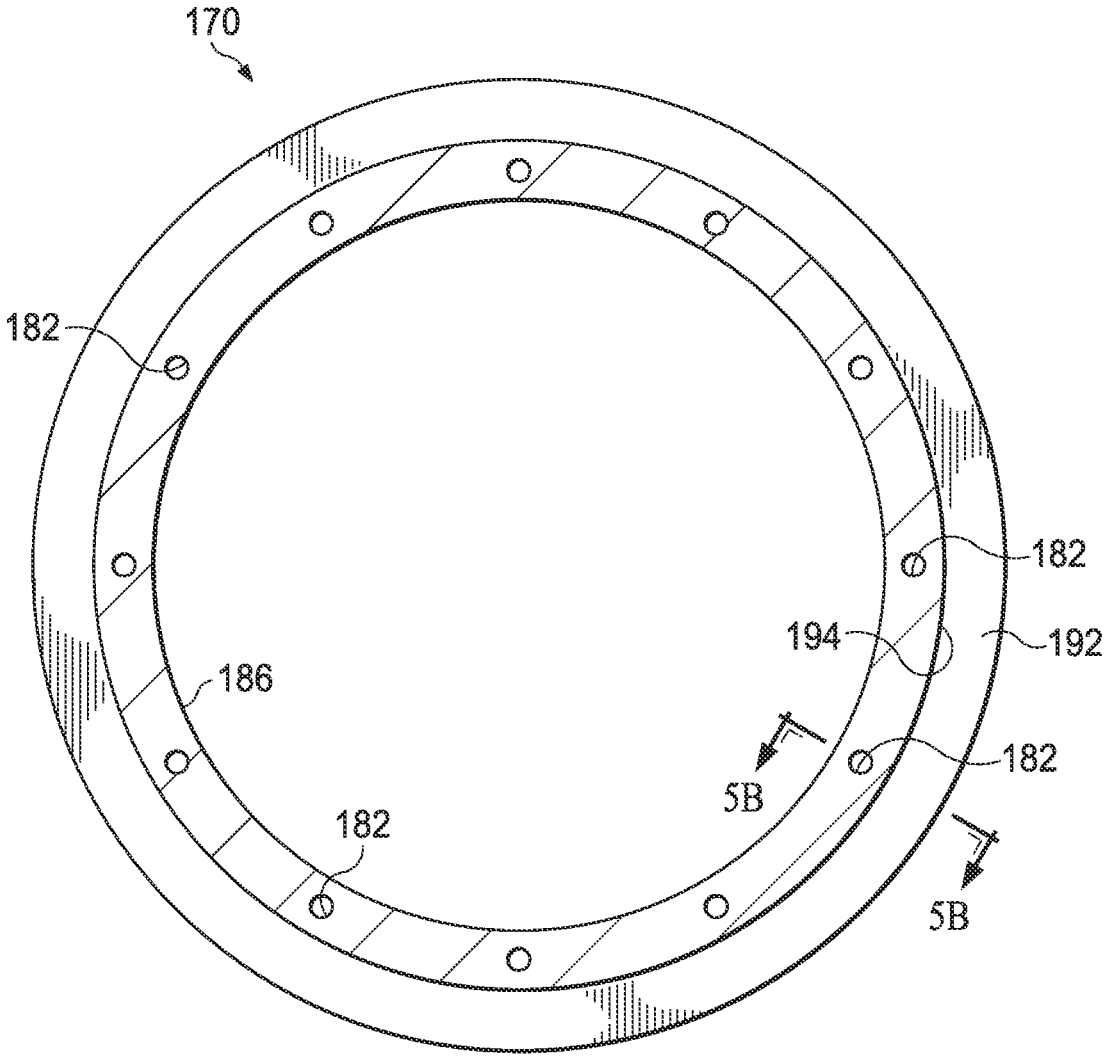
Figure 5E:
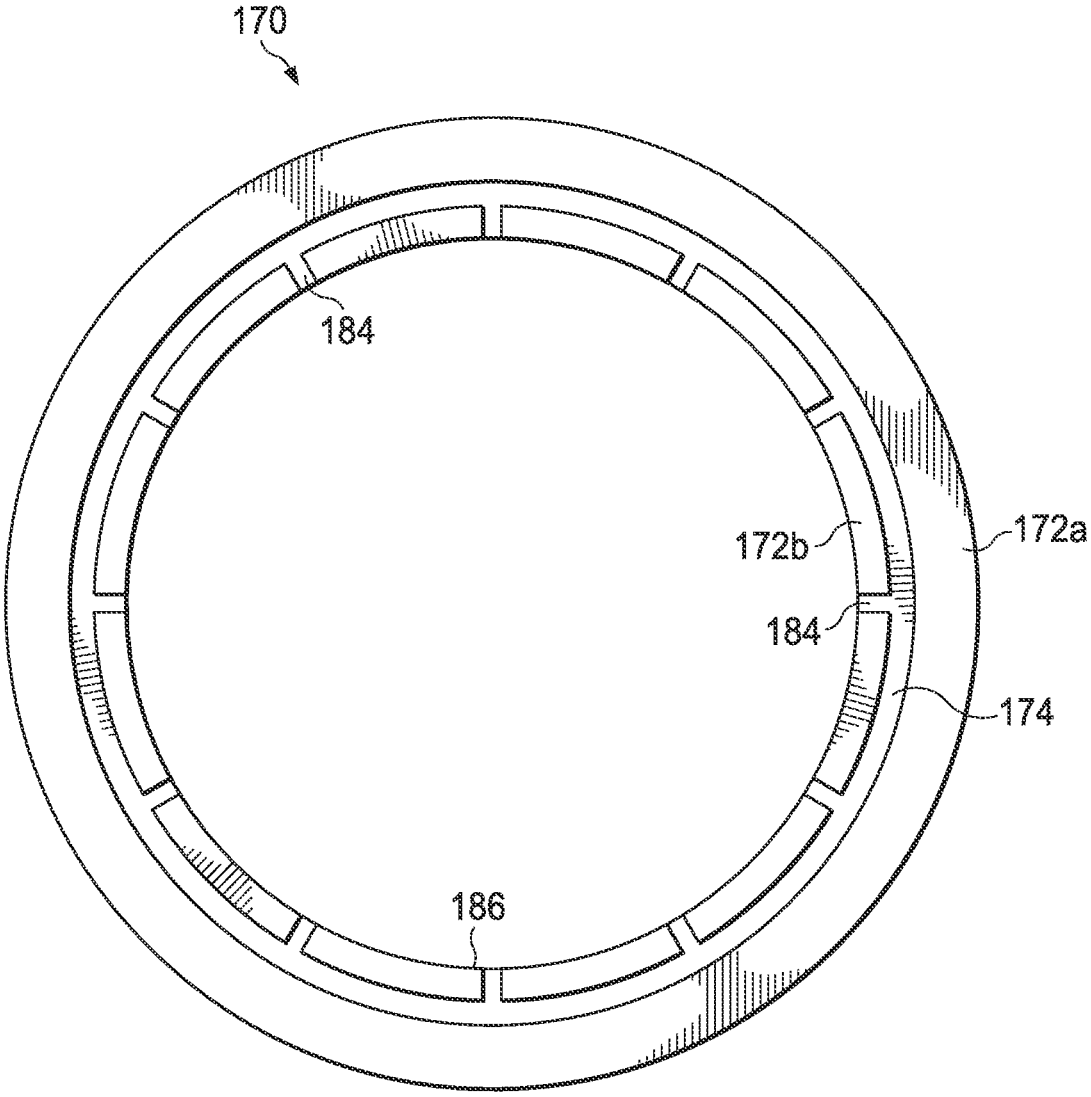

With reference to FIGS. 5B and 5D, the third ring 170 further includes a plurality of axially extending third apertures 182 evenly distributed circumferentially around an inner perimeter of the third ring. A single third aperture 182 is shown in FIG. 5B. FIG. 5D (not drawn to scale) shows the distribution of the third apertures 182 about the inner perimeter. The third apertures 182 comprise blind apertures made in the rear surface 180 and passing only partially through the third ring 170. The number of third apertures 182 and the angular spacing between third apertures 182 in the third ring 170 matches the number of second apertures 162 and the angular spacing between second apertures in the second ring 140. A drive pin 190 is installed into and extends between each angularly aligned pair of second and third apertures 162 and 182, respectively. A first end of the drive pin 190 is installed in second aperture 162 and the opposite second end of the drive pin 190 is installed in the third aperture 182. The drive pins 190 collectively function to attach the third ring 170 to the second ring 140. As the second ring 140 is press-fit within the second gland 108, the drive pin 190 attachment of the third ring 170 to the second ring ensures that the third ring will not rotate with the first ring 130 when the cone 102 is rotated.

The L-shape of the third ring 170 further assists in defining the third gland 150 by presenting an annular structure defined by a radial surface 192 extending outwardly perpendicularly away from the axis of cone rotation and a cylindrical surface 194 extending perpendicularly and rearwardly from the radial surface toward the surface 176 parallel to the axis of cone rotation.

An O-ring sealing member 200 (for example, with a circular cross-section) is inserted within the third gland 150 and radially compressed between the cylindrical surface 154 of the second ring 140 and the cylindrical surface 194 of the third ring 170. The O-ring sealing member 200 may further be axially compressed between the radial surface 152 of the second ring 140 and the radial surface 192 of the third ring 170. Because the first and second rings 140 and 170, respectively, are attached to each other through the drive pins 190, the compressed O-ring sealing member 200 forms a static seal between the grease side and exterior (for example, mud) side of the sealing system 100. The sliding seal between the grease side and exterior side is provided by the opposed first and second metal seal faces 134 and 172, respectively.

With reference to FIG. 5A, a coil spring 210 is installed in each first aperture 160. A first end of the coil spring 210 engages the radial surface 118 at the base of the shaft region 104. A second end of the coil spring 210 engages the biasing surface 176 of the third ring 170. Thus, each coil spring 210 is compressed between the radial surface 118 and the biasing surface 176. In this configuration, the coil spring 210 functions to apply an axially directed force against the third ring 170 so as to maintain sliding/sealing contact between the first metal seal face 134 of the first ring 130 and the second metal seal face 172 of the third ring 170. The first and second rings 140 and 170, respectively, are attached to each other through the drive pins 190 to preclude differential angular movement. The drive pin 190 is, however, axially slidable within at least one of the openings 162 and 182 so as to permit differential axial movement of the third ring 170 relative to the press-fit second ring 140 in response to the axial directed force supplied by the coil spring 210 and any axial movement of the cone 102.

Although the biasing surface 176 is illustrated as a separate surface from the rear surface 180 of the third ring 170, it will be understood that the biasing surface 176 and rear surface 180 may, in an alternative embodiment, comprise a same surface of the third ring 170 against which the second end of the coil spring 210 applies the axially directed force to maintain the sealing relationship between the first and second metal seal faces 134 and 172, respectively.

The second portion 172*b* of the second metal seal face 172 does not provide for sealing (due to the presence of radially extending channels 184 and annular channel 174), but instead functions as a self-aligning guiding face for the sliding seal. The third ring 170 is somewhat flexible due to its short axial length. Through the careful arrangement of hydraulic forces on the seal ring and in response to the circumferentially distributed force supplied by the plurality of coil springs 210 against the third ring 170, the sliding seal becomes self-aligning to any tilting (i.e., waviness) present on the first metal seal face 134 as a result of press-fitting the first ring 130 with the first gland 106. The second portion 172*b* is pre-loaded by the coil spring 210 and pressure caused loads. The contact force will vary as needed to ensure that second portion 172*b* maintains contact with the surface 134 in spite of any circumferential variation due to face tilt (i.e., waviness of surface 134 as a result of the press fit). This ensures that first portion 172*a* is in sealing contact with surface 134 (i.e., the surfaces maintain a parallel face contact).

In the illustrated embodiment of FIG. 5A, the aperture 160 is shown passing completely through the flange region 146 so that the first end of the spring 210 engages the radial surface 118. In an alternative embodiment, the aperture 160 is instead a blind opening (similar, for example, to that shown for the aperture 182. In the blind opening configuration, the spring 210 would reside within the aperture 160 with the first end engaging a bottom surface of the aperture and the second end engaging the biasing surface 176.

While the preferred implementation of FIGS. 5A and 5B shows the mounting of the second ring to shaft region 104 using the second gland 108, it will be understood that in an alternative embodiment the ring 140 may comprise the regions 142, 146 and 148 with region 142 mounted to the shaft region 104 using any suitable mounting means (including, for example, a welded attachment). Likewise, the first ring 130 may alternatively be mounted within the first gland 106 using any suitable mounting means (including, for example, a welded attachment).

While a coil spring 210 is illustrated to reside in aperture 160 and supply the biasing axial force against the third ring 170, it will be understood that the aperture could take on shapes other than a circular hole and that the coil spring 210 could alternatively comprise other spring or energizing structures known to those skilled in the art (including, for example, a leaf spring or elastic member) that are inserted within the aperture.

Although preferred embodiments of the method and apparatus have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A sealing system for a drill bit including a shaft region and a rotating cone, comprising:

a first annular gland defined in the rotating cone;

a first ring press-fit in the first annular gland and having a first metal seal face;

a second annular gland defined at a base of the shaft region;

a second ring press-fit in the second annular gland, said second ring including a radially extending flange region having a plurality of first axially extending apertures and a plurality of second axially extending apertures;

a third ring positioned between the first and second rings, said third ring including a second metal seal face in contact with the first metal seal face and further including a biasing surface axially opposite the second metal seal face and a plurality of third axially extending apertures;

a spring member inserted within each first axially extending aperture and configured to apply an axial force against the biasing surface of the third ring; and a pin member inserted between each pair of second and third axially extending apertures.

2. The sealing system of claim 1, wherein the shaft region includes a cylindrical surface and a radial surface extending perpendicular from the cylindrical surface, and wherein the second gland is formed in the radial surface of the shaft region.

3. The sealing system of claim 1, further comprising:

a third annular gland formed between the second ring and third ring; and an O-ring sealing member compressed within the third annular gland.

4. The sealing system of claim 1, wherein the shaft region includes a cylindrical surface and a radial surface extending perpendicular from the cylindrical surface, and wherein the spring member includes a first end which engages the radial surface of the shaft region and a second end which engages the biasing surface of the third ring.

5. The sealing system of claim 1, wherein the biasing surface is located at a distal end of an axially extending member projecting from a rear surface of the third ring.

6. The sealing system of claim 1, wherein the second metal seal face on the third ring comprises a pair of coaxially arranged surface portions separated from each other by an annular channel.

7. The sealing system of claim 6, wherein a first one of the pair of coaxially arranged surface portions is in sliding and sealing configuration with the first metal seal face on the first ring.

8. The sealing system of claim 7, wherein a second one of the pair of coaxially arranged surface portions includes a plurality of radially extending channels connected to the annular channel.

9. The sealing system of claim 1, wherein the first and second apertures alternate locations about a circumference of the second ring.

10. The sealing system of claim 1, wherein the spring member is a coiled spring.

11. A sealing system for a drill bit including a shaft region and a rotating cone, comprising:

a first annular gland defined in the rotating cone;

a first ring mounted in the first annular gland and having a first metal seal face;

a second ring mounted to the shaft region and including a flange having a plurality of first axially extending apertures;

a third ring including a second metal seal face in contact with the first metal seal face and further including a biasing surface axially opposite the second metal seal face; and a biasing member inserted within each first axially extending aperture and configured to apply an axial force against the biasing surface of the third ring.

12. The sealing system of claim 11, wherein the second ring further includes a plurality of second axially extending apertures and the third ring further includes a plurality of third axially extending apertures aligned with the plurality of second axially extending apertures, further comprising:

a pin member inserted between each pair of second and third axially extending apertures.

13. The sealing system of claim 11, wherein the shaft region includes a cylindrical surface and a radial surface extending perpendicular from the cylindrical surface, and further comprising a second annular gland formed in the radial surface at a base of the shaft region, wherein the second ring is press-fit into the second gland.

14. The sealing system of claim 11, wherein the shaft region includes a cylindrical surface and a radial surface extending perpendicular from the cylindrical surface, and wherein the biasing member comprises a coil spring including a first end which engages the radial surface of the shaft region and a second end which engages the biasing surface of the third ring.

15. The sealing system of claim 11, wherein second metal seal face on the third ring comprises a pair of coaxially arranged surface portions separated from each other by an annular channel, and wherein a first one of the pair of coaxially arranged surface portions is in sliding and sealing configuration with the first metal seal face on the first ring.

16. The sealing system of claim 15, wherein a second one of the pair of coaxially arranged surface portions includes a plurality of radially extending channels connected to the annular channel.

17. The sealing system of claim 11, further comprising:

a third annular gland formed between the second ring and third ring; and an O-ring sealing member compressed within the third annular gland.

18. A sealing system for a drill bit including a shaft region and a rotating cone, comprising:

a first annular gland defined in the rotating cone;

a first ring mounted in the first annular gland and having a first metal seal face;

a second ring mounted to the shaft region and including a flange having a plurality of first axially extending apertures;

a third ring including a second metal seal face in contact with the first metal seal face and further including a plurality of second axially extending apertures aligned with the plurality of first axially extending apertures; and a pin member inserted between each pair of second and third axially extending apertures.

19. The sealing system of claim 18, wherein the flange of the second ring further includes a plurality of third axially extending apertures, further including:

a biasing member inserted within each third axially extending aperture and configured to apply an axial force against a biasing surface of the third ring.

20. The sealing system of claim 18, wherein second metal seal face on the third ring comprises a pair of coaxially arranged surface portions separated from each other by an annular channel, and wherein a first one of the pair of coaxially arranged surface portions is in sliding and sealing configuration with the first metal seal face on the first ring.

21. The sealing system of claim 20, wherein a second one of the pair of coaxially arranged surface portions includes a plurality of radially extending channels connected to the annular channel.

22. The sealing system of claim 18, further comprising:

a third annular gland formed between the second ring and third ring; and an O-ring sealing member compressed within the third annular gland.

23. The sealing system of claim 18, wherein the shaft region includes a cylindrical surface and a radial surface extending perpendicular from the cylindrical surface, and further comprising a second annular gland formed in the radial surface at a base of the shaft region, wherein the second ring is press-fit into the second gland.

* * * * *